US010937571B2

(12) United States Patent
Jadhav et al.

(10) Patent No.: US 10,937,571 B2
(45) Date of Patent: Mar. 2, 2021

(54) BUSHING WITH INTEGRATED ELECTRONICS

(71) Applicant: Eaton Intelligent Power Limited, Dublin (IE)

(72) Inventors: Ranjit Jadhav, Pune (IN); Arend Lammers, TV Hengelo (NL); Rahul Pingale, Pune (IN); Amritendu Das, West Bengal Pin (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/470,257

(22) PCT Filed: Dec. 19, 2017

(86) PCT No.: PCT/EP2017/083664
§ 371 (c)(1),
(2) Date: Jun. 17, 2019

(87) PCT Pub. No.: WO2018/115027
PCT Pub. Date: Jun. 28, 2018

(65) Prior Publication Data

US 2020/0082961 A1 Mar. 12, 2020

(30) Foreign Application Priority Data

Dec. 20, 2016 (IN) ..... 201611043504

(51) Int. Cl.
*H01B 17/00* (2006.01)
*H01B 17/26* (2006.01)
(Continued)

(52) U.S. Cl.
CPC ..... *H01B 17/005* (2013.01); *H01B 17/26* (2013.01); *H01F 27/04* (2013.01); *H01R 4/64* (2013.01); *H01R 13/665* (2013.01)

(58) Field of Classification Search
CPC combination set(s) only.
See application file for complete search history.

(56) References Cited

U.S. PATENT DOCUMENTS 4,115,779 A * 9/1978 Dantzler ..... H01Q 1/084 343/715
4,924,067 A * 5/1990 Wilhelmson ..... G05D 23/1902 219/241
(Continued)

FOREIGN PATENT DOCUMENTS

FR 2678115 A1 12/1992
WO WO 2013113954 A1 8/2013

*Primary Examiner* — Jenny L Wagner
*Assistant Examiner* — Krystal Robinson
(74) *Attorney, Agent, or Firm* — Leydig, Voit & Mayer, Ltd.

(57) ABSTRACT

A bushing includes: an elongate electrical conductor; an insulation layer arranged around the elongate electrical conductor; an electrically conducting sleeve coaxially arranged with the electrical conductor; and a ring shaped printed circuit board with electrical components coaxially arranged around the electrical conductor. The sleeve and the printed circuit board are embedded in the insulation layer. The ring shaped printed circuit board is positioned in an axial direction between both ends of the electrically conducting sleeve.

12 Claims, 2 Drawing Sheets

(51) Int. Cl.

| | |
|---|---|
| ***H01F 27/04*** | (2006.01) |
| ***H01R 4/64*** | (2006.01) |
| ***H01R 13/66*** | (2006.01) |

(56) References Cited

U.S. PATENT DOCUMENTS 5,455,488 A * 10/1995 Rhoades ..... H05B 47/11 315/156
5,457,450 A * 10/1995 Deese ..... H05B 45/50 340/912
6,166,323 A * 12/2000 Kelch ..... H02B 13/035 174/21 JS
6,462,731 B1 * 10/2002 Stoffers ..... G05G 9/047 345/161
6,572,402 B2 * 6/2003 Lin ..... H01R 13/7172 439/490
6,719,578 B1 * 4/2004 Klassen ..... H01R 13/523 439/20
7,086,892 B2 * 8/2006 Tanacan ..... H01R 13/6691 439/490
7,607,937 B1 * 10/2009 Chang ..... H01R 13/7175 362/114
7,677,916 B2 * 3/2010 Chang ..... H01R 4/029 439/490
8,011,935 B2 * 9/2011 Ko ..... H01R 13/5845 439/490
2007/0029879 A1 * 2/2007 Eldredge ..... H02J 1/08 307/18
2008/0024116 A1 1/2008 Clemens et al.
2008/0094764 A1 * 4/2008 Zhang ..... H01R 13/6691 361/42
2009/0160427 A1 * 6/2009 Drake ..... G01R 19/16566 324/72
2011/0081852 A1 * 4/2011 Sahibzada ..... F24F 11/30 454/256
2012/0019267 A1 * 1/2012 Tabuchi ..... G01R 15/18 324/686
2012/0168224 A1 * 7/2012 Seifert ..... H01B 9/065 174/70 C
2013/0025912 A1 * 1/2013 Hoefner ..... H01B 17/36 174/156
2019/0093837 A1 * 3/2019 Dicken ..... F21V 23/002

* cited by examiner

BUSHING WITH INTEGRATED ELECTRONICS

CROSS-REFERENCE TO PRIOR APPLICATIONS

This application is a U.S. National Phase application under 35 U.S.C. § 371 of International Application No. PCT/EP2017/083664, filed on Dec. 19, 2017, and claims benefit to Indian Patent Application No. IN 201611043504, filed on Dec. 20, 2016. The International Application was published in English on Jun. 28, 2018 as WO 2018/115027 A1 under PCT Article 21(2).

FIELD

The invention relates to a bushing.

BACKGROUND

A bushing is known in the electrical field of medium and high voltages as an insulated device that allows an electrical conductor to pass safely through a typically earthed conducting barrier such as the wall of a transformer or circuit breaker.

Presently for switchgear voltage measurement, voltage transformers or resistive voltage divider circuits are used. But as these voltages transformer or resistive divider circuits are connected with the high voltage bus, the voltage transformers or resistor divider circuits are very big in size because of the high bus voltage. Similarly, current transformers are used for switchgear high current measurement. In general the current transformers have a magnetic saturation problem due to high current amplitude. The current transformers are also very big in size in order to handle high current measurement.

More compact solutions are known, for example from WO 2013113954, in which a voltage sensor or current sensor is embedded in the insulation layer of the bushing. However, each type of sensor has a different arrangement and mounting, such that combining of the known sensors in one bushing is difficult.

WO 2013113954 shows a bushing having a voltage sensor and a current sensor concentrically arranged and embedded in potting material. Due to the arrangement of both sensors in line with each other, the length of the bushing will increase. Furthermore, when only one of the sensor is to be embedded in the bushing, a different embodiment of the bushing is needed, or the length of the bushing will be unnecessarily long. However, due to the usual space limitations a compact design is desirable.

Thus during manufacturing of the bushing according to the prior art, different embodiments need to be available, depending on the type of sensor embedded, which increases the variety and the number of parts to be kept in stock.

SUMMARY

In an embodiment, the present invention provides a bushing, comprising: an elongate electrical conductor; an insulation layer arranged around the elongate electrical conductor; an electrically conducting sleeve coaxially arranged with the electrical conductor; and a ring shaped printed circuit board with electrical components coaxially arranged around the electrical conductor, wherein the sleeve and the printed circuit board are embedded in the insulation layer, and wherein the ring shaped printed circuit board is positioned in an axial direction between both ends of the electrically conducting sleeve.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
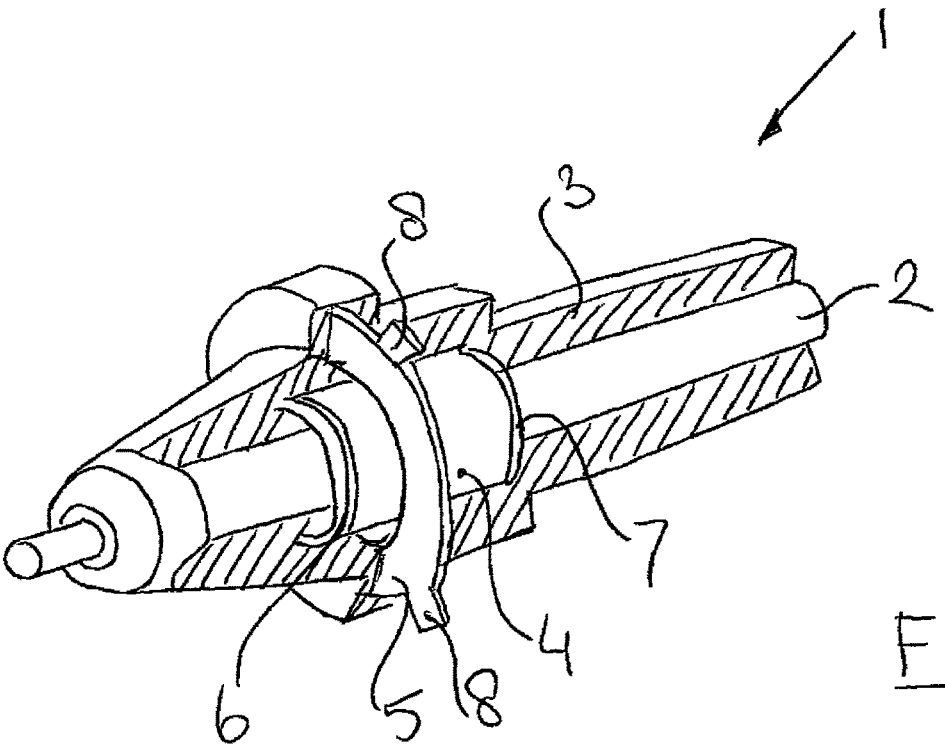
FIG. 1 shows a perspective and partly cut-away view of a first embodiment of the bushing according to the invention.

In an embodiment, the present invention reduces the above mentioned disadvantages with a bushing comprising:

- an elongate electrical conductor;
- an insulation layer arranged around the elongate electrical conductor;
- an electrically conducting sleeve coaxially arranged with the electrical conductor; and
- a ring shaped printed circuit board with electrical components coaxially arranged around the electrical conductor
- wherein the sleeve and the printed circuit board are embedded in the insulation layer and
- wherein the ring shaped printed circuit board is positioned in axial direction between both ends of the electrically conducting sleeve.

With the bushing according to the invention, it is possible to arrange a variety of sensors in the bushing, without changing the design of the bushing, such as the length.

The electrical conducting sleeve provides a screen for the printed circuit board, such that the electrical components on the board are less influenced by the electrical field of the elongate electrical conductor. Without such a screen the electrical field would be too high for the electrical components to function.

Using a ring shaped printed circuit board provides sufficient space for the components and it allows to evenly distribute electrical components around the circumference of the electrical conductor, which is for some types of sensors desired.

Furthermore, a bushing typically has a widened portion, for example to provide a mounting flange, such that sufficient space is available in the bushing to accommodate both the sleeve and the ring shaped circuit board.

In a preferred embodiment, the printed circuit board comprises at least one radial extension, which extension extends out of the insulation layer. This extension can be used for positioning the printed circuit board in the mold when molding the insulation layer. The extensions can further be used as terminal for the electronic components inside of the bushing and thus allow for easy connection.

In another preferred embodiment a protective layer is arranged on the printed circuit board for protecting the electrical components arranged on the printed circuit board.

A bushing typically gets hot during use and the insulation layer may typically expand differently than the printed circuit board and the components arranged thereon. To prevent that due to temperature changes, the electrical components are sheared of the circuit board, a protective layer could be provided.

Also during manufacturing of the bushing, the epoxy is applied in liquid or semi liquid form. During solidification, the epoxy will generate thermo-mechanical stress to the components arranged on the circuit board. As a result the electrical components may break or unmount from the circuit board. The protective layer according to the invention prevents this from occurring.

Preferably the protective layer has a higher elasticity and/or a higher plasticity than the insulation layer. Due to the higher elasticity and/or higher plasticity, the protective layer can easily take up the differences in expansion.

The insulation layer typically comprises an epoxy material.

In yet another embodiment of the bushing according to the invention a second electrically conducting sleeve is coaxially arranged enveloping the electrical components of the printed circuit board for shielding the electrical components for external electrical and/or magnetic fields.

Electrical conductors are typically arranged in a threesome corresponding to the electrical phases. So, other electrical conductors, generating their own electrical and/or magnetic field will be close. As a result the electrical components on the printed circuit board could also be influenced by the external electrical and/or magnetic fields. With the second electrically conducting sleeve, also a screen for the electrical components is provided against external influences.

Preferably, the second electrically conducting sleeve is of a soft magnetic material. This ensures that magnetic fields are easily shielded.

Still another embodiment of the bushing according to the invention further comprising a capacitor arranged on the printed circuit board and wherein the electrically conducting sleeve is electrically connected to the printed circuit board to provide in combination with the capacitor a voltage divider.

The electrically conducting sleeve, which provides the shielding of the printed circuit board, can also embody a capacitor together with the electrical conductor. By arranging a capacitor on the printed circuit board, a voltage divider is provided, which can easily measure high voltages.

Yet another embodiment of the bushing according to the invention further comprising a Rogowski coil arranged on the printed circuit board. A Rogowski coil needs to run around an electrical conductor to measure the alternating current in the electrical conductor. As the printed circuit board already is annular, it provides a suitable basis for arranging a Rogowski coil.

The Rogowski coil could be provided as tracks on the printed circuit board, or for example as a second printed circuit board, around which the wire for the coil is wound, which second circuit board is connected to the first printed circuit board.

A further embodiment of the bushing according to the invention further comprising a magnetic field sensor, such as a Hall sensor or a Giant magnetoresistance sensor, arranged on the printed circuit board.

These magnetic field sensor can measure the magnetic field generated by the electrical conductor and based on the measurements, an accurate current measurement can be done. Again, the printed circuit board provides a suitable and compact base for arranging such sensors in the bushing.

Yet a further embodiment of the bushing according to the invention comprises a mounting flange radially extending from the insulation layer for mounting the bushing.

With the mounting flange, the bushing can be mounted for example in a wall of a switch gear cabinet.

FIG. 1 shows a first embodiment of a bushing 1 according to the invention. The bushing 1 has an elongate electrical conductor 2, which is enveloped by an insulation layer 3, which is typically epoxy material.

An electrically conducting sleeve 4 is coaxially arranged around the elongate electrical conductor 2 and also embedded in the insulation layer 3. Also coaxially arranged is an annular printed circuit board 5. This printed circuit board 5 is positioned on the outside of the sleeve 4 in axial direction between both ends 6, 7 of the electrically conducting sleeve 4.

Figure 2:
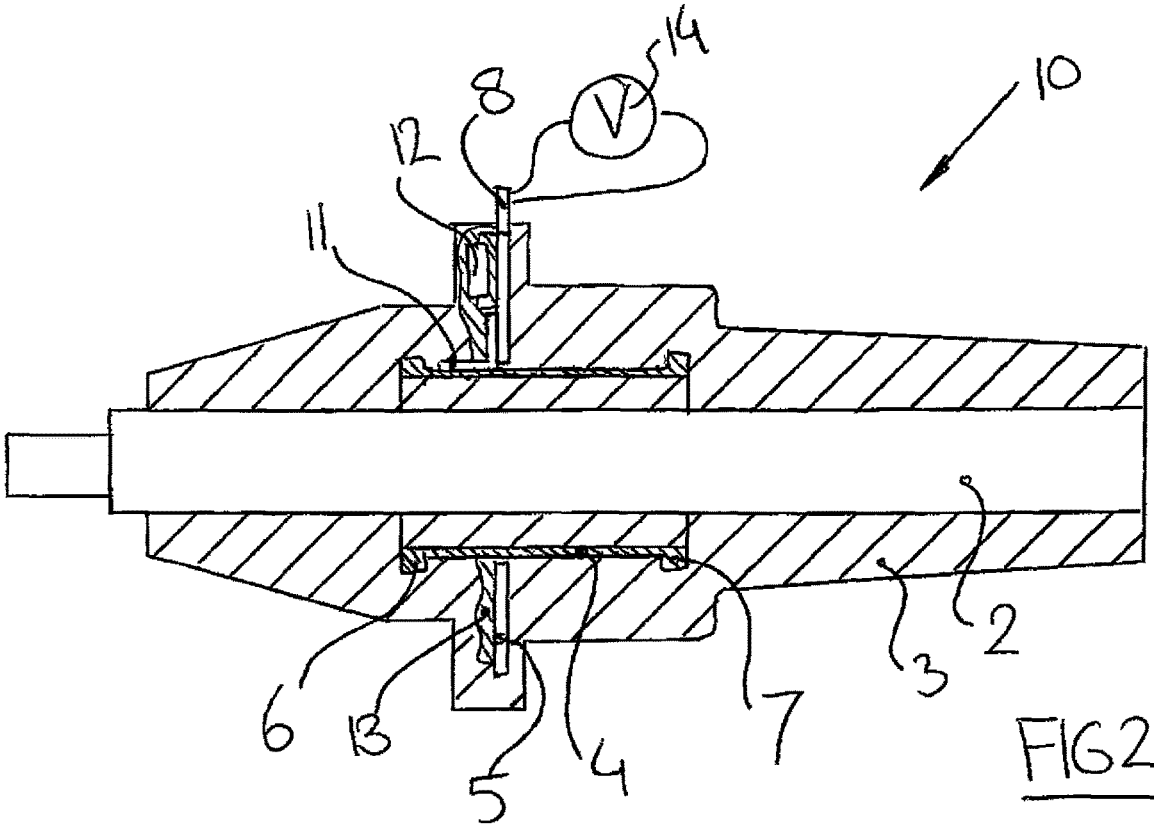
FIG. 2 shows a cross section of a second embodiment of a bushing according to the invention.

FIG. 2 shows a cross-section of a second embodiment 10 of a bushing according to the invention. The bushing 10 corresponds largely with the first embodiment 1 and similar elements are designated with the same reference signs.

In this embodiment 10, the electrically conducting sleeve 4 is electrically connected via a connector 11 to the printed circuit board 5. Furthermore, a capacitor 12 is arranged on the printed circuit board 5. This allows for a voltage divider consisting of a first capacitance of the elongate electrical conductor 2 and the electrically conducting sleeve 4 and a second capacitance of the capacitor 12.

The sleeve 4 will shield the electrical components 12 largely from the electrical field of the electrical conductor 2.

The printed circuit board 5 is provided with a protective layer 13 covering the electrical components 12. Preferably, the protective layer 13 is softer, i.e. has a higher elasticity and/or a higher plasticity, than the insulation layer 3.

The printed circuit board 5 has an extension 8, which extends out of the insulation layer 3 to provide a terminal connection for a voltage indicator 14.

Figure 3:
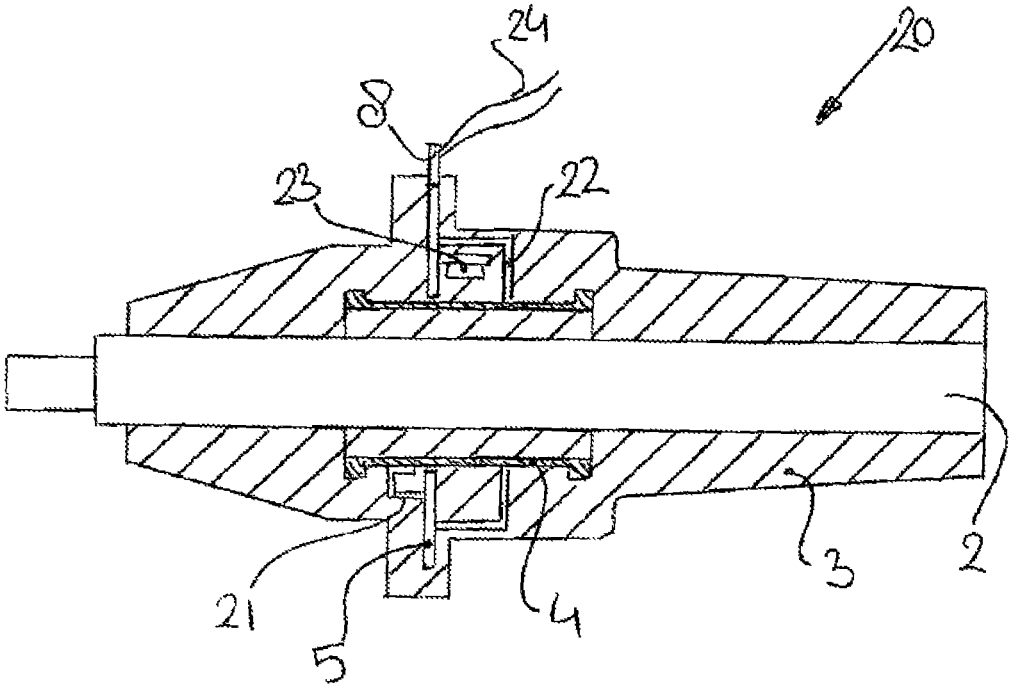
FIG. 3 shows a cross section of a third embodiment of a bushing according to the invention.

FIG. 3 shows a third embodiment 20 of a bushing according to the invention. The bushing 20 corresponds largely with the first embodiment 1 and similar elements are designated with the same reference signs.

The electrically conducting sleeve 4 is connected via a connector 21 to the printed circuit board. A second electrically conducting sleeve 22 is coaxially arranged around the elongate electrical conductor 2 and the sleeve 4. This provides for an area in the insulation layer 3, in which electrical components 23 are largely enveloped by the sleeves 4 and 22. This reduces the electrical field of the elongate electrical conductor 2 and any external influences, such that a sensitive sensor 23, such as a Hall sensor or GMR, can measure for example the magnetic field.

The sleeves 4, 22 are acting as screens. The electrical field from the conductor 2 is substantially reduced by the sleeve 4. The external electrical and/or magnetic field is substantially reduced by sleeve 22. As a result the measurement of the magnetic sensor 23, such as a Hall sensor or GMR, will not be disturbed by any external noise field.

The connections of the sensor 23 are connected with the printed circuit board 5 using an interfacing connector and an external lead 24 can be connected to the printed circuit board 5, via the extension 8.

Figure 4:
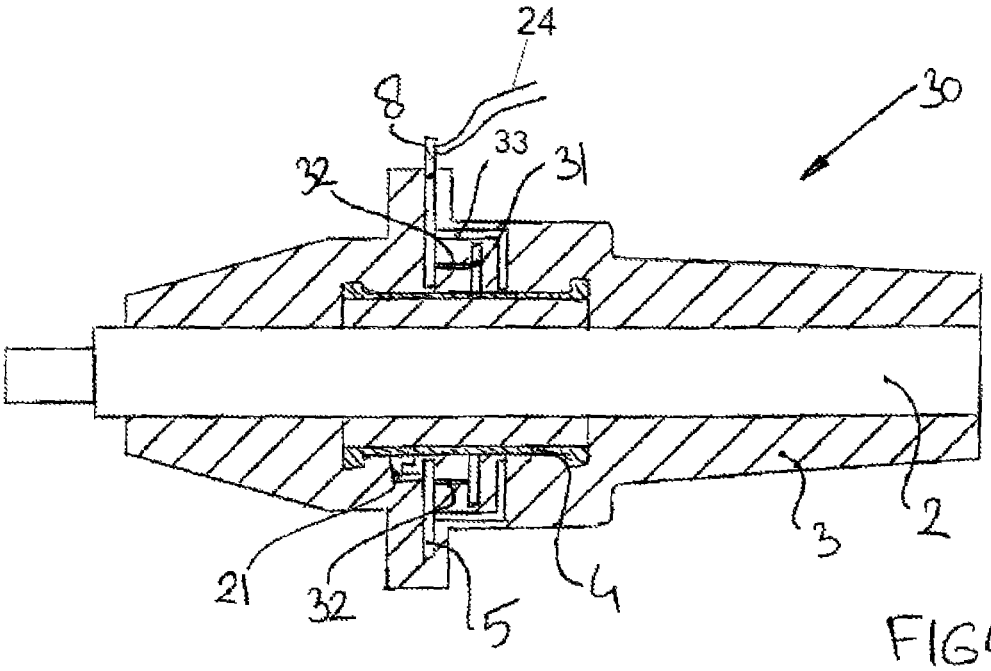
FIG. 4 shows a cross section of a fourth embodiment of a bushing according to the invention.

FIG. 4 shows a fourth embodiment 30 of a bushing according to the invention. The bushing 30 corresponds largely with the first embodiment 1 and similar elements are designated with the same reference signs.

In this embodiment 30, a second annular printed circuit board 31 is connected to the printed circuit board 5 via connectors 32. Such an annular printed circuit board 31 can for example be used for a Rogowski coil for measuring the alternating current in the elongate electrical conductor 2.

The second annular printed circuit board 31 is shielded from the electrical conductor 2 by the electrically conducting sleeve 4 and from any external fields by a second electrically conducting sleeve 33. This ensures that the electrical field from the conductor 2 is substantially reduced by the sleeve 4 to the both circular PCBs. The electrically conducting sleeve 4 is connected via a connector 21 to the printed circuit board 5. The external electrical and/or magnetic field is substantially reduced by sleeves 22 to the Rogowski coil PCB.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A bushing, comprising:

an elongate electrical conductor;

an insulation layer arranged around the elongate electrical conductor;

an electrically conducting sleeve coaxially arranged with the electrical conductor; and a ring shaped printed circuit board with electrical components coaxially arranged around the electrical conductor, wherein the sleeve and the printed circuit board are embedded in the insulation layer, and wherein the ring shaped printed circuit board is positioned in an axial direction between both ends of the electrically conducting sleeve.

2. The bushing according to claim 1, further comprising a protective layer arranged on the printed circuit board, the protective layer being configured to protect the electrical components arranged on the printed circuit board.

3. The bushing according to claim 1, wherein the insulation layer comprises an epoxy material.

4. The bushing according to claim 1, further comprising a capacitor arranged on the printed circuit board, wherein the electrically conducting sleeve is electrically connected to the printed circuit board so as to provide, in combination with the capacitor, a voltage divider.

5. The bushing according to claim 1, further comprising a mounting flange radially extending from the insulation layer, the mounting flange being configured to mount the bushing.

6. A bushing, comprising:

an elongate electrical conductor;

an insulation layer arranged around the elongate electrical conductor;

an electrically conducting sleeve coaxially arranged with the electrical conductor;

a ring shaped printed circuit board with electrical components coaxially arranged around the electrical conductor; and a protective layer arranged on the printed circuit board, the protective layer being configured to protect the electrical components arranged on the printed circuit board, wherein the sleeve and the printed circuit board are embedded in the insulation layer, wherein the ring shaped printed circuit board is positioned in an axial direction between both ends of the electrically conducting sleeve, and wherein the printed circuit board comprises at least one radial extension, which extension extends out of the insulation layer.

7. A bushing, comprising:

an elongate electrical conductor;

an insulation layer arranged around the elongate electrical conductor;

an electrically conducting sleeve coaxially arranged with the electrical conductor;

a ring shaped printed circuit board with electrical components coaxially arranged around the electrical conductor, and a protective layer arranged on the printed circuit board, the protective layer being configured to protect the electrical components arranged on the printed circuit board wherein the sleeve and the printed circuit board are embedded in the insulation layer, wherein the ring shaped printed circuit board is positioned in an axial direction between both ends of the electrically conducting sleeve, and wherein the protective layer has a higher elasticity and/or a higher plasticity than the insulation layer.

8. A bushing, comprising:

an elongate electrical conductor;

an insulation layer arranged around the elongate electrical conductor;

a first electrically conducting sleeve coaxially arranged with the electrical conductor;

a ring shaped printed circuit board with electrical components coaxially arranged around the electrical conductor; and a second electrically conducting sleeve coaxially arranged enveloping the electrical components of the printed circuit board, the second electrically conducting sleeve being configured to shield the electrical components from external electrical and/or magnetic field, wherein the first electrically conducting sleeve and the printed circuit board are embedded in the insulation layer, and wherein the ring shaped printed circuit board is positioned in an axial direction between both ends of the first electrically conducting sleeve.

9. The bushing according to claim 8, wherein the second electrically conducting sleeve comprises a soft magnetic material.

10. A bushing, comprising:

an elongate electrical conductor;

an insulation layer arranged around the elongate electrical conductor;

an electrically conducting sleeve coaxially arranged with the electrical conductor;

a ring shaped printed circuit board with electrical components coaxially arranged around the electrical conductor; and a Rogowski coil arranged on the printed circuit board, wherein the sleeve and the printed circuit board are embedded in the insulation layer, and wherein the ring shaped printed circuit board is positioned in an axial direction between both ends of the electrically conducting sleeve.

11. A bushing, comprising:

an elongate electrical conductor;

an insulation layer arranged around the elongate electrical conductor;

an electrically conducting sleeve coaxially arranged with the electrical conductor;

a ring shaped printed circuit board with electrical components coaxially arranged around the electrical conductor; and a magnetic field sensor arranged on the printed circuit board, wherein the sleeve and the printed circuit board are embedded in the insulation layer, and wherein the ring shaped printed circuit board is positioned in an axial direction between both ends of the electrically conducting sleeve.

12. The bushing according to claim 11, wherein the magnetic field sensor comprises a Hall sensor or a Giant magnetoresistance sensor.

* * * * *